United States Patent [19]

Havins

[11] Patent Number: 4,995,839

[45] Date of Patent: Feb. 26, 1991

[54] APPARATUS FOR AUTOMATICALLY RAISING AND LOWERING BOAT MOTORS

[76] Inventor: Felton H. Havins, 300 NE. 6th St., Fort Worth, Tex. 76106

[21] Appl. No.: 283,587

[22] Filed: Dec. 13, 1988

[51] Int. Cl.[5] ..... B63H 5/12

[52] U.S. Cl. ..... 440/6; 440/53; 114/274

[58] Field of Search ..... 440/6, 53, 55, 56, 63, 440/64, 71; 114/39.1, 61, 274, 285

[56] References Cited

U.S. PATENT DOCUMENTS

| | | | |
|---|---|---|---|
| 2,274,200 | 2/1942 | Hill | 114/274 |
| 2,705,468 | 4/1955 | Dix | 115/18 |
| 2,775,219 | 12/1956 | Curtis | 115/41 |
| 3,236,202 | 2/1966 | Quady et al. | 114/61 |
| 3,426,723 | 2/1969 | Specht | 440/63 |
| 3,433,195 | 3/1969 | Poole | 114/66.5 |
| 3,881,443 | 5/1975 | Hamp | 115/18 |
| 4,227,480 | 10/1980 | Carras | 440/63 |
| 4,445,452 | 5/1984 | Loch | 114/282 |
| 4,482,330 | 11/1984 | Cook | 440/2 |
| 4,487,152 | 12/1984 | Larson | 114/274 |
| 4,832,642 | 5/1989 | Thompson | 114/285 |
| 4,838,817 | 6/1989 | Travis | 440/6 |

*Primary Examiner*—Basinger Sherman
*Assistant Examiner*—Stephen P. Avila
*Attorney, Agent, or Firm*—Geoffrey A. Mantooth; James C. Fails

[57] ABSTRACT

An apparatus for automatically raising and lowering boat motors includes a mounting configuration that allows the motor to move up out of the water and down into the water. A hydrofoil is connected with the motor. When the boat is propelled by a second motor, the water pushes up on the hydrofoil, forcing the first motor up out of the water. A locking device can be used to maintain the first motor in the up position. The locking device can be disengaged to allow the motor and hydrofoil to fall into the water. Alternatively, the motor and hydrofoil can be maintained in the up position by the force of water against the hydrofoil. When the second motor is shut down the motor and hydrofoil automatically drop into the water.

18 Claims, 5 Drawing Sheets

APPARATUS FOR AUTOMATICALLY RAISING AND LOWERING BOAT MOTORS

FIELD OF THE INVENTION

The present invention relates to apparatuses for automatically raising boat motors out of the water and to apparatuses for automatically raising and lowering boat motors respectively out of and into the water.

BACKGROUND OF THE INVENTION

Fishing boats are commonly equipped with secondary propulsion means such as electric trolling motors that supplement the primary internal combustion motors. The trolling motor is used to provide quiet propulsion at slow speeds during fishing operations.

When not in use, the trolling motor is stored out of the water, in order to minimize drag on the boat and to prevent damage to the trolling motor when the boat is propelled by the main motor. Prior art trolling motor mounting apparatuses typically require a manual raising and lowering of the trolling motor. Thus to ready the boat for trolling operations, the fisherman must go over to the trolling motor and lower the trolling motor into the water before going to his fishing position. When the fisherman is finished trolling and ready to use the main motor, he must go back over to the trolling motor and lift the trolling motor out of the water to its stowed position. It would be more convenient and easier for the fisherman if the trolling motor could be automatically raised and lowered.

Hamp, U.S. Pat. No. 3,881,443 exemplifies another type of motor mounting apparatus. A small electric motor is provided to automatically raise and lower the trolling motor. The trolling motor and the positioning motor share the same battery. A disadvantage with this type of motor mounting apparatus is that the positioning motor drains the battery and reduces the length of time that the trolling motor can be operated before recharging the battery. The reduction in trolling motor running time becomes noticeable if the positioning motor is frequently used. This same disadvantage is applicable to hydraulically actuated motor mounting apparatuses, which use electrical power from a battery to power the hydraulic pump. Another disadvantage with these types of motor mounting apparatuses is that the trolling motor can be inadvertently left in the down position, which may result in damage to the trolling motor if the boat is operated at high speed by the main motor.

SUMMARY OF THE INVENTION

It is an object of the present invention to provide an apparatus for automatically raising motors. It is another object of the present invention to provide an apparatus that automatically raises and lowers motors.

The apparatus of the present invention includes mounting means for mounting a motor to a boat and hydrofoil means for raising the motor. The mounting means allows the motor to move between a submerged position and an unsubmerged position when the boat is in the water. The hydrofoil means is coupled to the mounting means. As the boat is propelled by a second motor, the water pushes the hydrofoil up, thus automatically lifting the motor up out of the water to the unsubmerged position.

In one aspect, the hydrofoil means is a plate that is mounted beneath the motor. The hydrofoil is positioned at a slight angle to the water line, with its leading edge being higher than the trailing edge. When the boat is propelled by the second motor so as to raise the bow of the boat, the angle increases, thereby increasing the lift of the hydrofoil. In still another aspect, the hydrofoil serves as a protective guard when the motor is submerged.

In another aspect, the apparatus also includes locking means for locking the movable portion of the mounting means and the motor in the unsubmerged position. The locking means has means for unlocking the movable portion and allowing the motor to fall to the submerged position. In still another aspect, the apparatus includes damper means for damping the fall of the movable portion and the motor to the submerged position.

DESCRIPTION OF PREFERRED EMBODIMENTS

Figure 1:
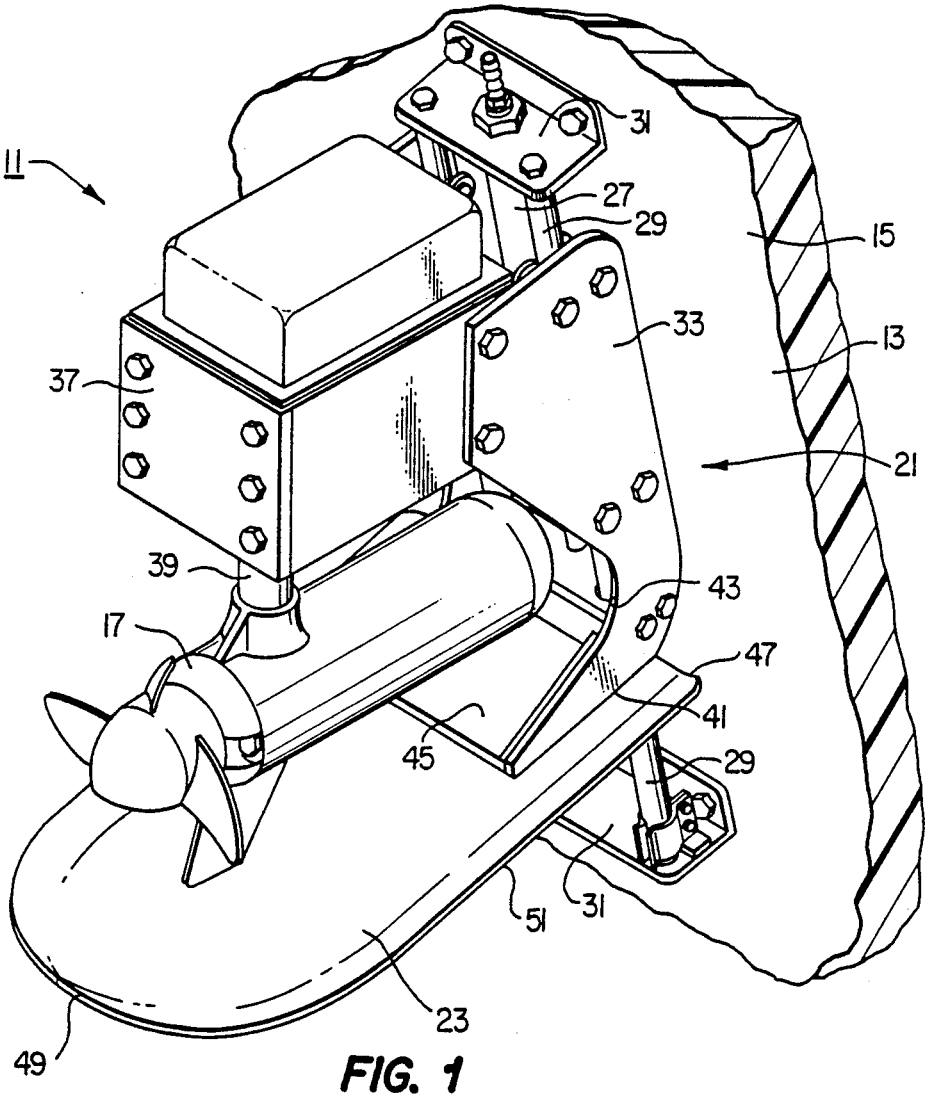
FIG. 1 is an isometric view of the apparatus of the present invention, in accordance with a preferred embodiment, mounted onto a boat transom.
Figure 2:
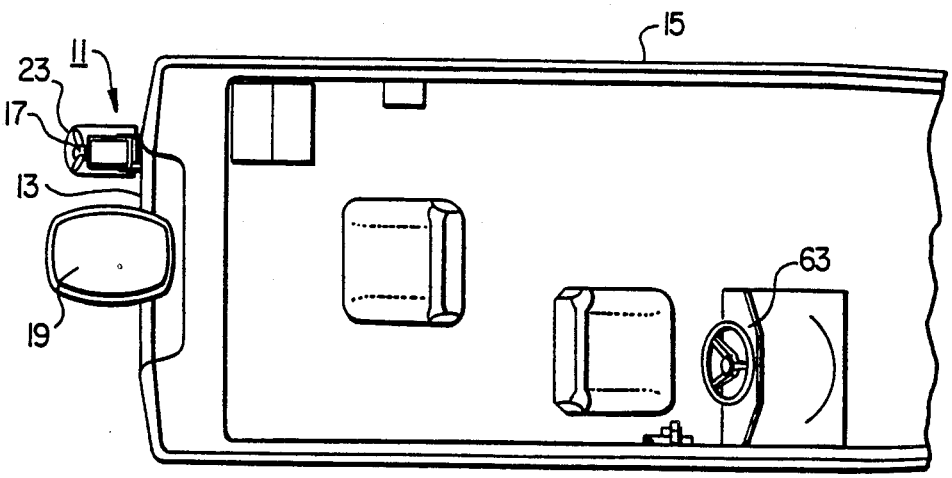
FIG. 2 is a plan view of the stern portion of a fishing boat showing the apparatus of the present invention.

In FIG. 1, there is shown an isometric view of the apparatus 11 of the present invention, in accordance with a preferred embodiment as mounted onto the transom 13 of a boat 15. The boat is equipped with a trolling motor 17 and with a main motor 19 (see FIG. 2). The trolling motor 17 is a conventional electric outboard motor such as may be used for fishing. The main motor 19 is typically gasoline powered and may be of the outboard type or the inboard type. The apparatus 11 is used for automatically raising and lowering the trolling motor 17 out of and into the water when the boat is in the water. In describing the apparatus of the present invention, it will convenient to refer to "up" and "down" with reference to the orientations of the drawings and to the orientation of the boat. The apparatus 11 includes mounting means 21 and a hydrofoil 23. Optional locking means 25 (see FIG. 5) and damping means 27 can be included and are described herein.

Referring to FIGS. 1, and 3–5, the mounting means 21 mounts the trolling motor to the boat while allowing the trolling motor to move up and down between a submerged position, where the trolling motor 17 is submerged in the water and ready for trolling operations, and an unsubmerged position, where the trolling motor is up out of the water for stowage. The mounting means 21 includes a fixed portion and a movable portion. The fixed portion has a pair of cylindrical rods 29 mounted to the boat transom 13 by way of angle brackets 31 at each end of the rods. The rods 29 are parallel to each other and are parallel to the transom 13. The rods 29, which are separated from each other by a short distance, are oriented in a generally vertical direction.

The movable portion has two side brackets 33 that are located on the outer sides of the rods 29. Each side bracket 33 is made up of a plate. The side brackets 33 have respective sets of rollers 35 that protrude inwardly towards the other respective side bracket. The rollers 35 of each side bracket 33 engage the nearest rod 29 in a movable fashion. In order to provide a good coupling between the movable portion and the fixed portion of the mounting means 21, each side bracket 33 has an upper set and a lower set of rollers that engage the respective rod. Each set of rollers has a fore roller, that engages the respective rod on its forward portion, and an aft roller, that engages the respective rod on its aft portion. The side brackets 33 protrude aft, where a steering means 37 is received. The steering means 37 is coupled to the inside portions of the side brackets and is positioned so as to not interfere with the movement of the side brackets 33 relative to the rods 29. A shaft 39 depends from the bottom of the steering means 37. The trolling motor 17 is coupled to the lower end of the shaft 39. The steering means 37 rotates the shaft 39 so as to turn the trolling motor, for steering control of the boat during trolling operations. The steering means is described in more detail in my U.S. patent application "BOAT SPEED AND DIRECTION CONTROL SYSTEM", Ser. No. 07/075,590, filed July 20, 1987, now U.S. Pat. No. 4,854,902. The side brackets 33 have bottom edges 41 that are located below the trolling motor. The trolling motor 17 is positioned so that it can turn without contacting the side brackets 33 or the rods 29. To prevent any such contact, the side brackets 33 are contoured so as to form a notch 43 in the aft edge of each side bracket. With the trolling motor thus mounted to the boat transom, the trolling motor and the side brackets 33 can move between up and down positions. When the boat is in the water, the trolling motor is submerged when it is in the down position. The trolling motor is unsubmerged when it is in the up position. Movement between the u and down positions is accomplished by the rollers 35 rolling along the rods 29. The rollers 35 minimize friction in moving the trolling motor up or down.

The hydrofoil 23 is a plate attached to the bottom edges 41 of the side brackets 33 so as to be located underneath the trolling motor 17. A bracket 45, which is attached to the upper surface of the hydrofoil 23, is coupled to the side brackets 33. The hydrofoil 23 is oriented so as to be generally horizontal when the boat is in the water. The hydrofoil is slightly angled to the water line, when the boat is stationary in the water, with the leading edge 47 higher than the trailing edge 49. This prevents the leading edge 47 from plowing under the water and increasing drag while maintaining the hydrofoil in an orientation where the water will always exert an upward force on the hydrofoil. In the preferred embodiment, the hydrofoil is angled at five degrees to the water line. The trailing edge 49 and the side edges 51 of the hydrofoil are bent slightly upwardly.

The hydrofoil 23 has an area that is sized to produce a sufficient lifting force so as to raise the trolling motor, the steering means, and the side brackets to the up position. The heavier the load that must be lifted, the larger the hydrofoil should be in order to achieve more upward force from the water. The power of the main motor 19 and the size of the boat are also considered in determining the size of the hydrofoil. The faster the boat, when powered by the main motor, the smaller the hydrofoil can be. In the preferred embodiment, the hydrofoil 23 is sized so as to extend the length of the trolling motor and to be much wider than the width of the trolling motor. Thus, the hydrofoil 23 forms a protective guard against underwater obstacles for the trolling motor 17, when the trolling motor is submerged. Because the hydrofoil 23 is attached to the side brackets 33, it remains fixed when the trolling motor 17 is turned for steering.

Figure 5:
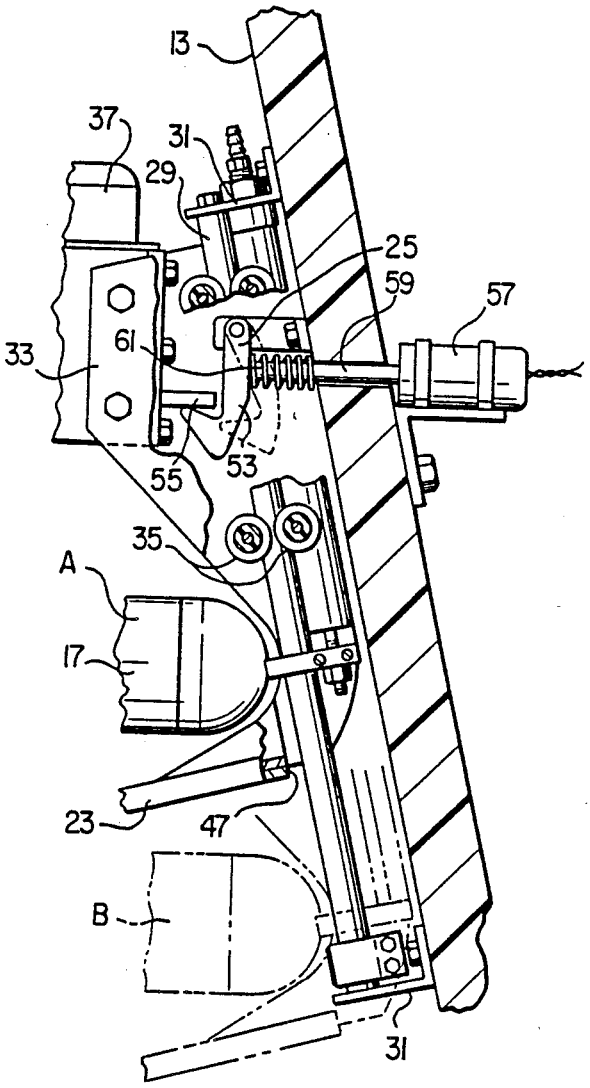
FIG. 5 is a schematic partial cross-sectional view of the boat transom, showing the locking means.

Referring to FIG. 5, the locking means 25 includes a solenoid actuated hook 53. The hook 53 is pivotally mounted to the transom 13 of the boat, between the two rods 29. The hook 53 pivots between fore and aft positions. In the aft position, the hook 53 engages a step 55 on the steering means 37 so as to maintain the trolling motor and the hydrofoil in the up position A. With the hook 53 in the fore position, the hook is disengaged from the step 55, allowing the trolling motor and the hydrofoil to fall to the down position B. The hook 53 is actuated by a solenoid 57 installed inside of the boat. A small hole is bored through the hull to receive the movable solenoid rod 59. The hook 53 is biased in the aft position by a coil spring 61 on the solenoid rod 59. The spring is positioned on the solenoid rod between the hook and the transom. When the solenoid 57 is energized, the hook 53 is pulled to the fore position. When the solenoid is deenergized, the hook returns to the aft position. The solenoid is actuated by a switch (not shown) on the boat operator's control panel 63 (see FIG. 2). The hook 53 is angled upwardly so that as the trolling motor moves to the up position from the down position, the step 55 contacts the lowermost portion of the hook such that the step forces the hook to the aft position. With the hook pushed out of the way, the step can continue to travel upwardly past the hook. When the step has passed the hook, the hook 53 snaps back to the aft position to prevent the step 55 and the trolling motor 17 from falling to the down position.

Figure 4:
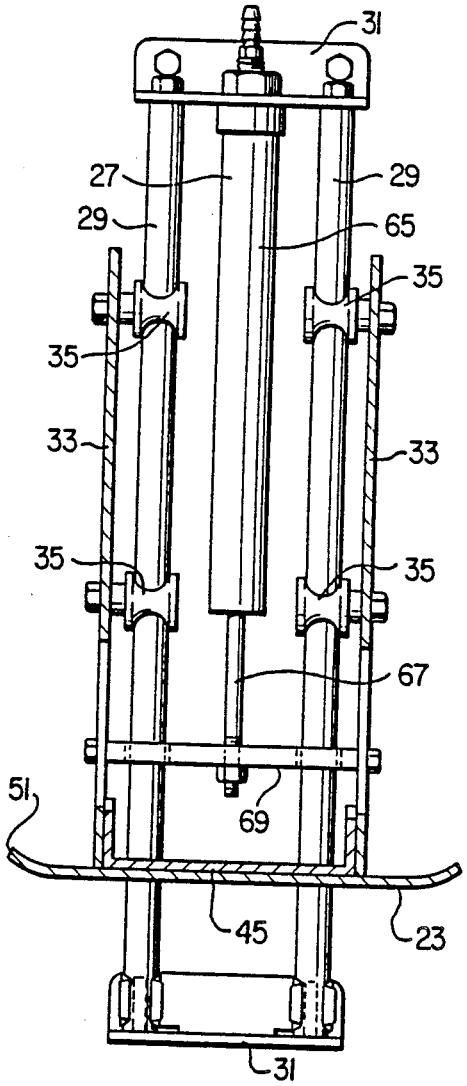
FIG. 4 is a cross-sectional view of the apparatus taken at lines IV—IV of FIG. 3.

The damper means includes a conventional gas spring 27 located between the rods 29 (see FIG. 4). The gas spring 27 has a cylindrical housing 65 and a piston rod 67, which is movable relative to the cylindrical housing. The housing 65 is mounted to the upper angle bracket 31 and the piston rod 67 is mounted to a cross bar 69, which in turn is coupled to the side brackets 33. The gas spring 27 slows the descent of the trolling motor 17 and the hydrofoil 23 into the water to the down position from the up position, in order to prevent a large splash that would scare away fish. The gas spring 27 provides no resistance to the raising of the trolling motor to the up position. In fact, the gas spring can be configured relative to the movable portion such that the gas spring provides some minor assistance in raising the trolling motor and the hydrofoil to the up position.

Figure 3:
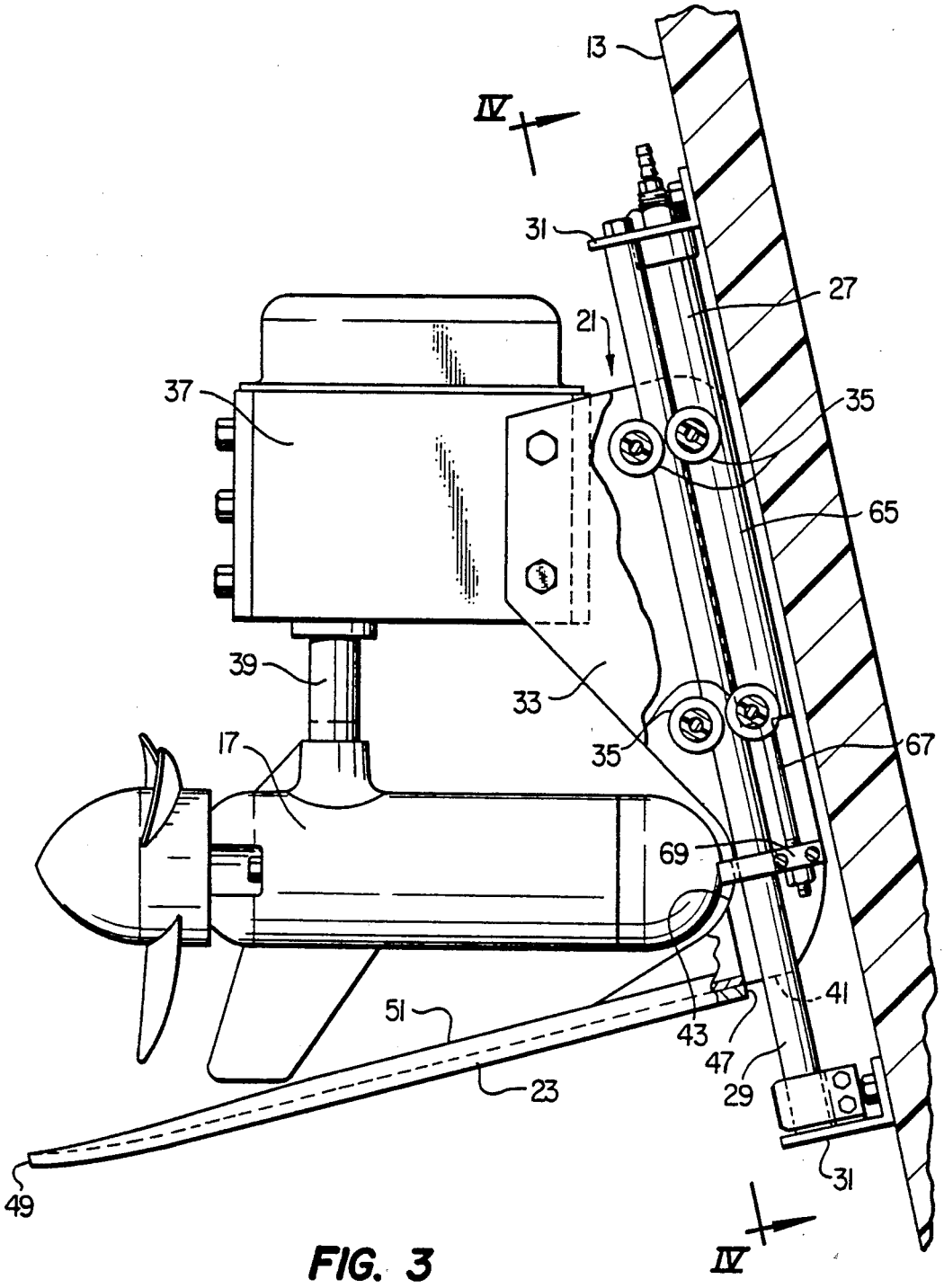
FIG. 3 is a schematic partially cut away side view of the apparatus of FIG. 1.

The operation of the apparatus 11 of the present invention will now be described. With the boat 15 in the water and the trolling motor 17 in the down position, the fisherman need only to start and engage the main motor 19 to propel the boat in a forward direction. The main motor 19 is controlled from the control panel 63 (see FIG. 2). As the main motor propels the boat at a sufficiently high speed, the bow of the boat lifts up in the water, increasing the angle of the hydrofoil to the surface of the water so as to lift the leading edge 47 even higher than the trailing edge 49. This increase in the angle of the hydrofoil to the surface of the water increases the force of water against the hydrofoil. The force of the water against the angled hydrofoil 23 pushes the hydrofoil, the trolling motor 17, the side brackets 33, the rollers 35, and the steering means 37 to the up position. The trolling motor is pushed upwardly more easily when the rods are inclined slightly downward and forward as shown in FIG. 3 because the rods are more aligned with the direction of force on the hydrofoil. Because the hydrofoil is fixed to the side brackets and can't be turned, the trolling motor can be turned in any direction when being lifted; the fisherman need not align the trolling motor into the fore and aft direction before the trolling motor is raised. In the up position, the trolling motor is stowed out of the water, minimizing drag on the boat and preventing damage to the trolling motor by underwater obstacles. The hydrofoil presents minimal drag to the boat when it is in the up position. The trolling motor is maintained in the up position by the hook 53 engaging the step 55. The apparatus 11 is completely automatic in raising the trolling motor out of the water; all the fisherman has to do is drive the boat.

When the fisherman reaches the next fishing spot, he merely actuates the solenoid 57 (if the locking means hook 53 has been utilized to lock the trolling motor in the up position) from the control panel 63 to release the trolling motor 17 and allow the trolling motor 17, the hydrofoil 23, the side brackets 33, the rollers 35, and the steering means 37 to fall into the water. The gas spring 27 slows the fall of the trolling motor and the hydrofoil to prevent a large splash when the trolling motor and hydrofoil enter the water. The trolling motor is now ready for trolling operations. The submerged hydrofoil presents minimal drag to the boat during trolling operations because the hydrofoil is nearly parallel to the surface of the water. The leading edge 47 is angled slightly upward to prevent the hydrofoil from being pushed down deeper.

The locking means can be positioned further up from the waterline, wherein when the trolling motor is in the up position, the locking means hook 53 will not engage the step 55. Instead, the trolling motor is maintained in the up position by the force of water against the hydrofoil. The hydrofoil rides on the surface of the water, ready to automatically drop to the down position when the main motor is shut down. The locking means would be used to secure the trolling motor during trailering operations. The trolling motor can be manually raised to the uppermost position so as to engage the locking means.

In the absence of water, as when, for example, the boat is on a trailer, the boat operator can manually lift the trolling motor to the up position, wherein the locking means would lock the trolling motor. To lower the trolling motor with the boat on a trailer, the operator can either energize the solenoid to release the locking means and allow the trolling motor to fall to the down position or manually disengage the locking means and lower the trolling motor.

Figures 6, 7:
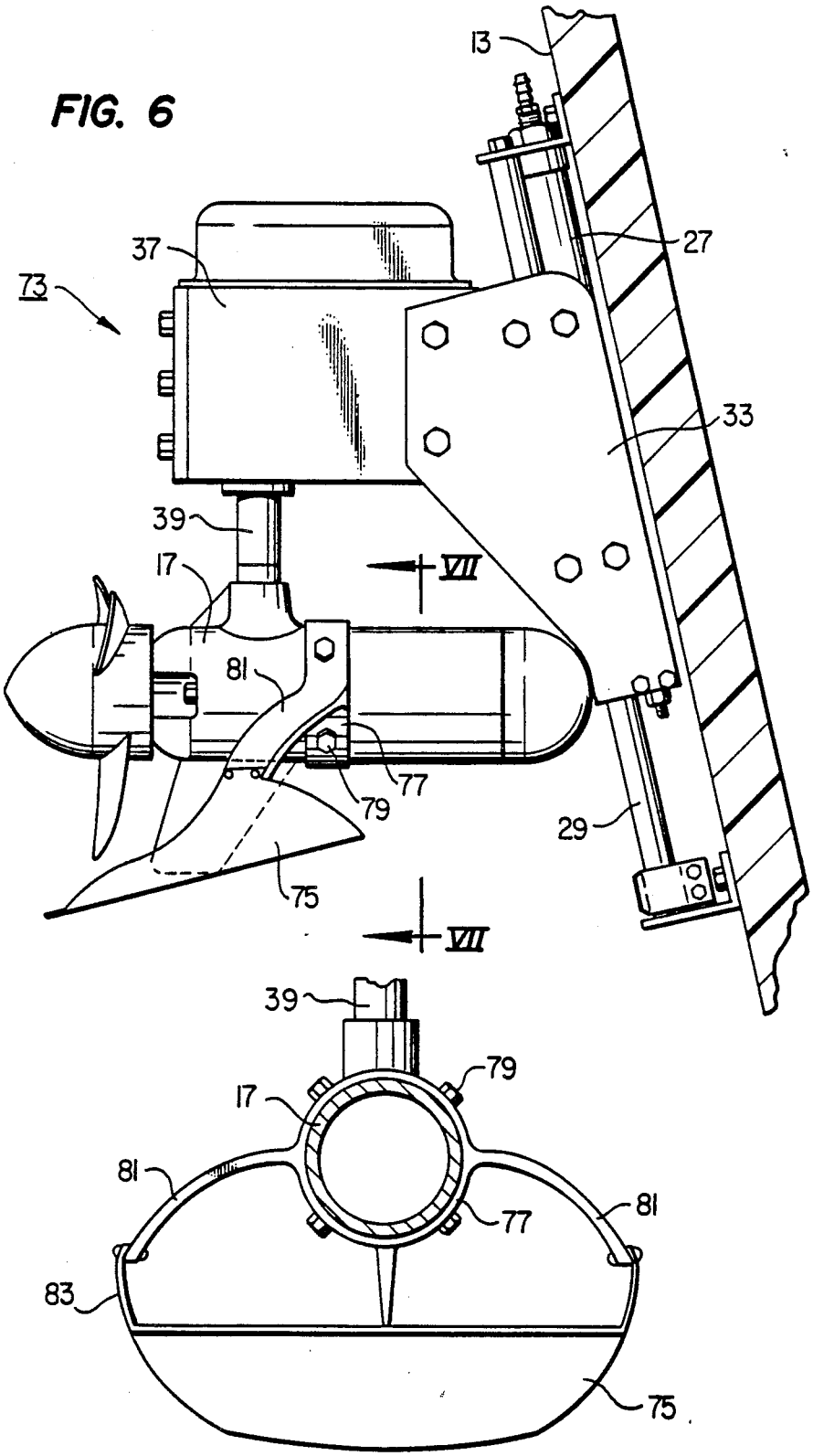
FIG. 6 is a schematic side view of the apparatus of the present invention, in accordance with another embodiment.
FIG. 7 is a schematic cross-sectional view taken at lines VII—VII of FIG. 6.

In FIGS. 6 and 7, the apparatus 73 of the present invention, in accordance with another embodiment, is shown. In this embodiment, the hydrofoil 75 is attached directly to the trolling motor 17 so as to turn with the trolling motor whenever the trolling motor is turned for steering. The hydrofoil 75 is attached directly to the trolling motor 17 by way of a collar 77. Set screws 79 are used to secure the collar to the trolling motor. The collar 77 has two arcuate arms 81 that extend laterally out to couple to each side of the hydrofoil 75. The sides 83 of the hydrofoil extend arcuately upwardly to meet the arms 81. Most of the hydrofoil 75 is positioned aft of the shaft 39 that couples the trolling motor to the steering means. Thus, when the main motor 19 is engaged, the hydrofoil 75 acts like a weathervane, straightening out the hydrofoil and the trolling motor so as to be aligned in a fore and aft direction. This allows the fisherman to automatically raise the trolling motor without being concerned as to the orientation of the trolling motor or the hydrofoil. The embodiment of FIGS. 6 and 7 operates as described above. For reasons of clarity, the locking means is not shown in FIG. 6.

Figure 8:
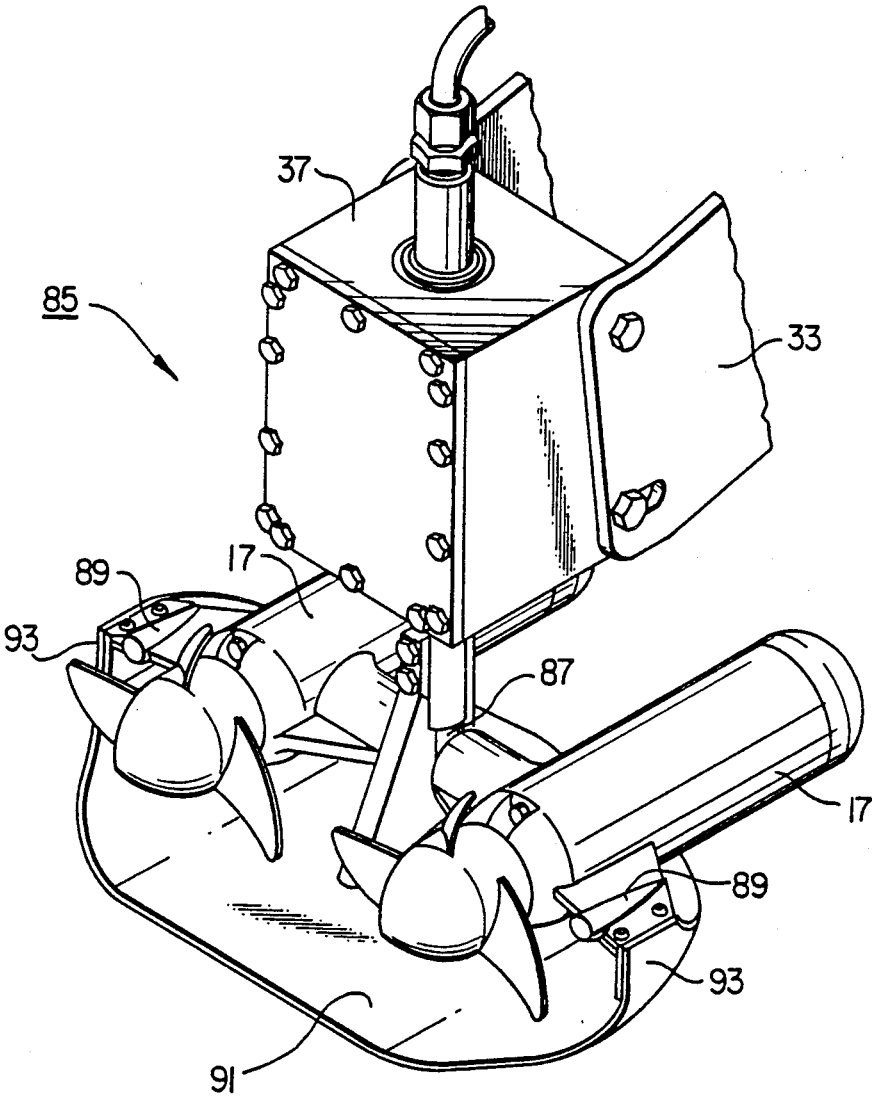
FIG. 8 is an isometric view of the apparatus invention, in accordance with another embodiment.

In FIG. 8, there is shown the apparatus 85 of the present invention in accordance with still another embodiment. In this embodiment, there are two trolling motors 17 mounted to a common shaft 87. The trolling motors ar turned sideways to receive the horizontal common shaft 87. The trolling motor stabilizer fins 89 extend laterally outward. The hydrofoil 91 is attached to the trolling motors at the respective stabilizer fins 89. Side portions 93 of the hydrofoil 91 extend upwardly to meet the stabilizer fins 89. Most of the hydrofoil 91 is positioned aft of the common shaft 87 in order to achieve the weathervane effect described above.

Although the apparatus of the present invention has been described with reference to trolling motors, other types of motors could be raised and lowered with the apparatus. For example, internal combustion motors could be lifted with the apparatus. Such motors, which run on gasoline or diesel fuel, may be used on large salt water boats for deep sea trolling. Also, the apparatus has been described with reference to the transom of a boat. However, the apparatus can be mounted to other portions of the hull of a boat.

Although the apparatus has been described as moving between up and down positions by the action of rollers on cylindrical rods, other structural arrangements could be utilized which allow the motor to be moved between a first or submerged position and a second or unsubmerged position. For example, an arrangement which utilizes sliding principles includes a tongue and groove arrangement, where the movable portion has a pair of tongues that slidingly engage grooves in the fixed portion. Another arrangement includes linear bearing means on the movable portion and rods on the fixed portion. The bearing means allow the movable portion to slide up and down along the fixed portion rods.

The foregoing disclosure and the showing made in the drawings are merely illustrative of the principles of this invention and are not to be interpreted in a limiting sense.

I claim:

1. An apparatus for automatically raising first propulsion means on a boat, said boat having second propulsion means, comprising:

(a) mounting means for mounting said first propulsion means to said boat such that said first propulsion means can move between a submerged position and an unsubmerged position when said boat is in the water;

(b) hydrofoil means for raising said first propulsion means from said submerged position to said unsubmerged position when said boat is being propelled by said second propulsion means, said hydrofoil means being coupled to said mounting means, said hydrofoil means being adapted to be submerged when said first propulsion means is in the submerged position;

(c) said mounting means providing for movement of said hydrofoil means and said first propulsion means such that said hydrofoil means maintains a relatively constant orientation with respect to a waterline of said boat so as to present minimal drag when said first propulsion means is in the unsubmerged position.

2. An apparatus for automatically raising an outboard motor on a boat, said boat having propulsion means in addition to said outboard motor, comprising:

(a) mounting means for mounting said motor to said boat, said mounting means comprising:

(i) a fixed position which is fixed to said boat;

(ii) a movable portion movably coupled to said fixed position, said motor coupled to said movable portion, said movable portion moving between a first position where said motor is submerged when said boat is in the water and a second position where said motor is submerged when said boat is in the water;

(b) hydrofoil means for automatically raising said movable portion from said first position to said second position when said boat is being propelled by said propulsion means, said hydrofoil means being coupled to said movable portion so as to be submerged when said movable portion is in the first position and said boat is in the water;

(c) said movable portion providing for movement of said first propulsion means from said first position to said second position such that said first propulsion means maintains a relatively constant orientation with respect to a waterline of said boat.

3. The apparatus of claim 2 further comprising means for locking said movable portion in the second position.

4. An apparatus for automatically raising an outboard motor on a boat, said boat having propulsion means in addition to said outboard motor, comprising:

(a) mounting means for mounting said motor to said boat, said mounting means comprising:

(i) a fixed position which is fixed to said boat;

(ii) a movable portion movably coupled to said fixed position, said motor coupled to said movable portion, said movable portion moving between a first position where said motor is submerged when said boat is in the water and a second position where said motor is unsubmerged when said boat is in the water;

(b) hydrofoil means for automatically raising said movable portion from said first position to said second position when said boat is being propelled by said propulsion means, said hydrofoil means being coupled to said movable portion so as to be submerged when said movable portion is in the first position and said boat is in the water;

(c) means for locking said movable portion in the second position, wherein said locking means comprises means for automatically unlocking said movable portion and allowing said movable portion to fall to the first position.

5. The apparatus of claim 4 wherein said mounting means further comprises damper means for damping the fall of said movable portion to the first position.

6. An apparatus for automatically raising an outboard motor on a boat, said boat having propulsion means in addition to said outboard motor, comprising:

(a) mounting means for mounting said motor to said boat, said mounting means comprising:

(i) a fixed position which is fixed to said boat;

(ii) a movable portion movably coupled to said fixed position, said motor coupled to said movable portion, said movable portion moving between a first position where said motor is submerged when said boat is in the water and a second position where said motor is unsubmerged when said boat is in the water;

(b) hydrofoil means for automatically raising said movable portion from said first position to said second position when said boat is being propelled by said propulsion means, said hydrofoil means being coupled to said movable portion so as to be submerged when said movable portion is in the first position and said boat is in the water;

(c) means for locking said movable portion in the second position, wherein said locking means is actuated by a solenoid, said locking means engages said movable portion when said movable portion is in the second position, said solenoid actuating said locking means so that said locking means disengages said movable portion and allows said movable portion to fall to the first position.

7. The apparatus of claim 6 wherein said mounting means further comprises damper means for damping the fall of said movable portion to the first position.

8. An apparatus for automatically raising an outboard motor on a boat, said boat having propulsion means in addition to said outboard motor, comprising:

(a) mounting means for mounting said motor to said boat, said mounting means comprising:

(i) a fixed portion which is fixed to said boat;

(ii) a movable portion movably coupled to said fixed portion, said motor coupled to said movable portion, said movable portion moving between a first position where said motor is submerged when said boat is in the water and a second position where said motor is unsubmerged when said boat is in the water;

(b) hydrofoil means for automatically raising said movable portion from said first position to said second position when said boat is being propelled by said propulsion means, said hydrofoil means being coupled to said movable portion so as to be submerged when said movable portion is in the first position and said boat is in the water, wherein said hydrofoil means comprises a plate having trailing and leading edges, said plate being positioned at a slight angle relative to a water line of said boat when said movable portion is in the first position such that said leading edge is closer to the water line than is said trailing edge; said plate angle increasing as the boat is propelled by said propulsion means at a speed which raises the bow of the boat.

9. The apparatus of claim 8 wherein said hydrofoil means is positioned underneath said motor.

10. The apparatus of claim 9 wherein said hydrofoil means plate extends horizontally beyond said motor in all directions, wherein said plate serves as a protective guard for said motor against underwater obstacles.

11. The apparatus of claim 8 wherein said hydrofoil means is coupled directly to said motor.

12. The apparatus of claim 8 wherein said fixed portion comprises plural rods fixed to a transom on said boat with said rods being in a generally vertical orientation, and said movable portion comprises bracket means and roller means, said bracket means being coupled to said motor, said roller means being coupled to said bracket means and positioned on said rods, said roller means allowing said movable portion to move along said rods.

13. An apparatus for automatically raising an outboard motor on a boat, said boat having propulsion means in addition to said outboard motor, comprising:

(a) mounting means for mounting said motor to said boat, said mounting means comprising:
  (i) a fixed portion which is fixed to said boat;
  (ii) a movable portion movably coupled to said fixed position, said motor coupled to said movable portion, said movable portion moving between a first position where said motor is submerged when said boat is in the water and a second position where said motor is unsubmerged when said boat is in the water;

(b) hydrofoil means for automatically raising said movable portion from said first position to said second position when said boat is being propelled by said propulsion means, said hydrofoil means being coupled to said movable portion so as to be submerged when said movable portion is in the first position and said boat is in the water;

(c) wherein said fixed portion comprises a rod fixed to said boat in a generally vertical orientation, and said movable portion comprises bracket means and roller means, said bracket means being coupled to said motor, said roller means being coupled to said bracket means and positioned on said rod, said roller means allowing said movable portion to move along said rod.

14. An apparatus for automatically raising an outboard motor on a boat, said boat having propulsion means in addition to said outboard motor, comprising:

(a) mounting means for mounting said motor to said boat, said mounting means comprising:
  (i) a fixed portion which is fixed to said boat;
  (ii) a movable portion movably coupled to said fixed portion, said motor coupled to said movable portion, said movable portion moving between a first position where said motor is submerged when said boat is in the water and a second position where said motor is unsubmerged when said boat is in the water;

(b) damper means for damping the fall of said movable portion to the first position;

(c) hydrofoil means for automatically raising said movable portion from said first position to said second position when said boat is being propelled by said propulsion means, said hydrofoil means being coupled to said movable portion so as to be submerged when said movable portion is in the first position and said boat is in the water, said hydrofoil means comprising a plate having leading and trailing edges, said plate being positioned at a slight angle relative to a water line of said boat when said movable portion is in the first position such that said leading edge is closer to the water line than is said trailing edge; said plate angle increasing as the boat is propelled by said propulsion means at a speed which raises the bow of the boat.

15. The apparatus of claim 14 wherein said hydrofoil means is positioned underneath said motor and said hydrofoil means is coupled directly to said motor such that said hydrofoil means turns with said motor when said motor is turned for steering.

16. The apparatus of claim 14 wherein said hydrofoil means is positioned underneath said motor and said hydrofoil means is coupled to said movable portion so as to remain fixed when said motor is turned for steering.

17. The apparatus of claim 14 wherein said motor is a first motor, said apparatus automatically raising a second outboard motor, said second motor being coupled to said movable portion such that said second motor is submerged when said movable portion is in the first position and said boat is in the water and such that said second motor is unsubmerged when said movable portion is in the second position and said boat is in the water.

18. An apparatus comprising:

(a) mounting means for mounting an outboard motor onto a boat, said mounting means comprising:
  (i) a fixed portion adapted to be fixedly coupled to said boat;
  (ii) a movable portion movably coupled to said fixed portion, said movable portion adapted to be coupled to said motor, said movable portion moving between a first position where said motor is submerged when said boat is in the water and a second position where said motor is unsubmerged when said boat is in the water;

(b) hydrofoil means for automatically raising said movable portion from said first position to said second position when said boat is being propelled through the water by alternative propulsion means, said hydrofoil means being coupled to said movable portion so as to be submerged when said movable portion is in the first position;

(c) said movable portion providing for movement of said hydrofoil means and said first propulsion means from said first position to said second position such that said first propulsion means and said hydrofoil means maintain a relatively constant orientation with respect to a waterline of said boat so that said hydrofoil means presents minimal drag when said first propulsion means is in the unsubmerged position.

* * * * *